US005746147A

United States Patent [19]

Carnevali

[11] Patent Number: 5,746,147

[45] Date of Patent: May 5, 1998

[54] TRIM DEVICE FOR A BOAT RUDDER

[76] Inventor: Jeffrey D. Carnevali, 3262 36th Ave. SW, Seattle, Wash. 98126

[21] Appl. No.: 624,688

[22] Filed: Mar. 25, 1996

[51] Int. Cl.[6] ..... B63H 25/06

[52] U.S. Cl. ..... 114/162

[58] Field of Search ..... 114/162; 440/66

[56] References Cited

U.S. PATENT DOCUMENTS 2,331,706 10/1943 Livingston ..... 114/162

4,307,677 12/1981 Jastam et al. ..... 114/162

4,342,275 8/1982 Brix et al. ..... 114/162

4,463,700 8/1984 Becker ..... 114/162

4,510,880 4/1985 Kuribayashi ..... 114/162

*Primary Examiner*—Stephen Avila

*Attorney, Agent, or Firm*—Jensen & Puntigam, P.S.

[57] ABSTRACT

An adjustable trim tab at the trailing edge of a rudder which is positioned to compensate for the torque generated by the propeller.

2 Claims, 2 Drawing Sheets

TRIM DEVICE FOR A BOAT RUDDER

TECHNICAL FIELD

The present invention relates to rudders for boats, and more particularly for a single-screw boat such as a water ski boat, wherein the torque of the screw, absent a compensating device on the rudder, would cause the boat to normally drive in a curved fashion. The present invention includes a recessed portion at the rear of the rudder, into which is placed a complementary element which may selectively be angled slightly to the surface of the rudder, causing a slight cavitation, compensating for the propeller but yet be readily adjustable to accommodate a different propeller if a change is made.

BACKGROUND OF THE INVENTION

It is well known and recognized that the thrust of a single propeller in a ski boat or the like, if not counteracted by a balancing force, creates a torque which causes the boat to travel in a curvilinear path. High performance boats like water ski boats have in the past utilized a single propeller operating at high speeds controlling the direction of the boat by an independent rudder placed aft of the propeller which has been configured on the appropriate side of the rudder such that the non-flat surface, when passing through the water, counteracts the torque generated by the propeller. This method of counteracting the propeller torque has proven to be adequate and worthwhile, however, should a propeller break or should the user of the boat desire a different speed, the change of the propeller would require either a further modification of the rudder, or in the alternative replacing the rudder entirely.

DISCLOSURE OF THE INVENTION

With the above-noted prior art and problems in mind, it is an object of the present invention to provide a rudder having a trim device which can be infinitely adjustable within a given range to compensate for the torque generated by the propeller.

It is another object of the present invention to provide a rudder which can have its fluid dynamic quickly and easily altered through the use of an integral trim tab to accommodate the change to a new propeller.

It is yet another object of the present invention to provide a torque-balancing rudder which is lightweight.

It is still a further object of the present invention to provide a torque-compensating rudder which is simple in construction, inexpensive to manufacture and provides an adjustable torque-compensating surface.

BEST MODE FOR CARRYING OUT THE INVENTION

Figure 1:
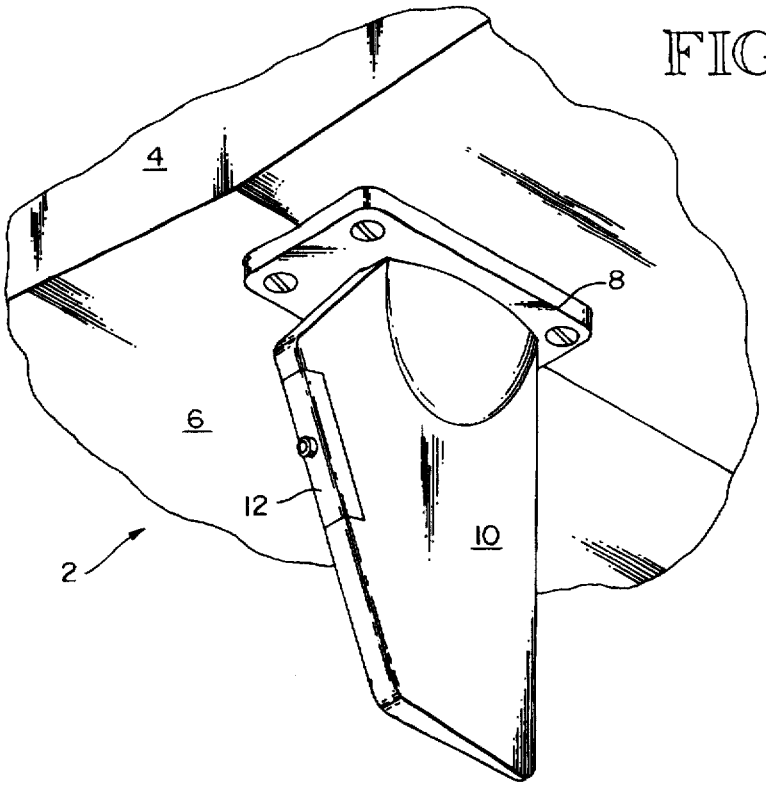
FIG. 1 is an isometric view disclosing the inventive rudder mounted to the hull of a boat.

As seen in FIG. 1, the rear hull portion of a boat 2 can be seen, including the stern 4 and the bottom 6. A plate 8 is mounted to the bottom and includes a rudder 10 extending downwardly therethrough, including the inventive trim tab 12, to be described in greater detail hereinafter. It is understood that the rudder 10 is secured to a rigid shaft which extends upwardly through the plate 8 and the bottom 6 of the boat hull 2, and is connected to means for changing the relative angular position relative to the keel of the boat, causing a change in direction of travel for the boat.

Figure 2:
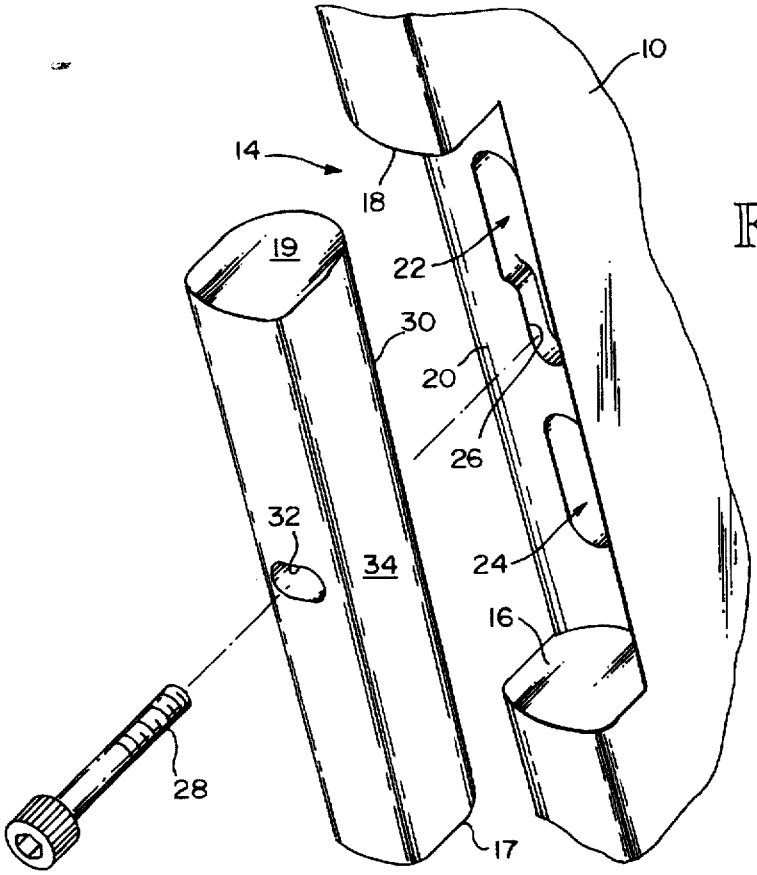
FIG. 2 is an exploded view disclosing the inventive trim tab as mounted to a hollow rudder.

Reference is now had to FIG. 2, wherein the inventive trim tab may more easily be seen. Prior to entering into discussion as to the trim tab itself, it is recognized that the rudder size and shape will be largely determined by the shape of the hull of the boat and the propulsion system. It is recognized that the present invention is used only to change the exterior configuration of the rudder to compensate for torque generated by the single screw propeller or other influences which may cause the boat to travel in something other than a straight line when not being actively steered.

As seen in FIG. 2, the rudder 10 has a recess 14 at its trailing edge. Recess 14 includes generally parallel flat surfaces 16, 18 at its top and bottom ends and a rearwardly facing concave surface 20 forming its inner definition, wherein the concave surface is generated about an axis parallel to the trailing edge of the rudder. It is to be noted that there are openings 22, 24 in the arcuate surface 20, since this is the hollow rudder form. It is to be noted further that there is a necked-down portion 26 of opening 22 which will receive and secure a self-locking nut into which a threaded fastener 28 is secured. The trim tab itself is of a size and dimension which will mate with the opening 14 in the rudder 10, including a curved surface 30 which is substantially congruent with the surface 20 such that the element 12, when not tightly secured by fastener 28, will be easily rotated about its axis, which would be substantially coincident with the axis forming curved surface 20. A horizontally oriented elongated slot 32 to receive fastener 28 extends through the element 12, allowing the element 12 to be rotated about its axis. When element 12 is rotated to the appropriate position, limited by the extent of opening 32 which compensates for the forces causing the boat to turn, it is secured in place by tightening of element 28.

Figure 3:
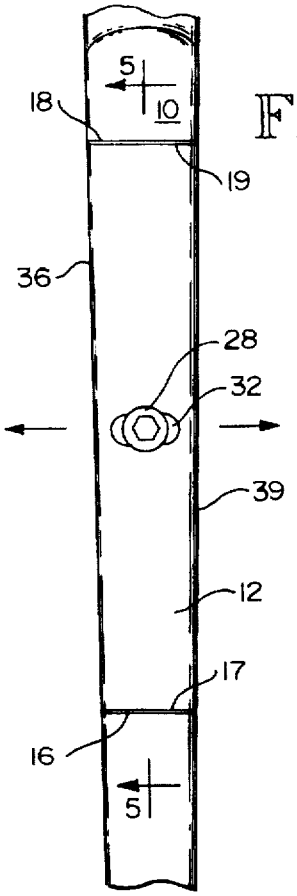
FIG. 3 is an elevational view of a portion of the inventive rudder showing the trim tab in a neutral position.

Reference is now had to FIG. 3, wherein the trim tab 12 is in its neutral position and, as can be seen, the surfaces 17, 19 which are the upper and lower surfaces of the trim tab are substantially congruent with the surfaces 16, 18 and the sides 34, 36 are substantially coplanar to the respective sides of the rudder 10, forming a fluid dynamic surface.

Figure 4:
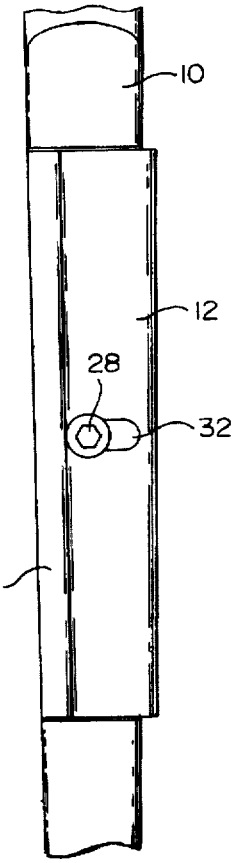
FIG. 4 is a rear elevational view of the inventive rudder showing the trim tab at a maximum torque-compensating position.

As seen in FIG. 4, the trim tab has been slightly displaced to the right, causing a counteracting force, preventing the boat from turning to the right.

Figure 5:
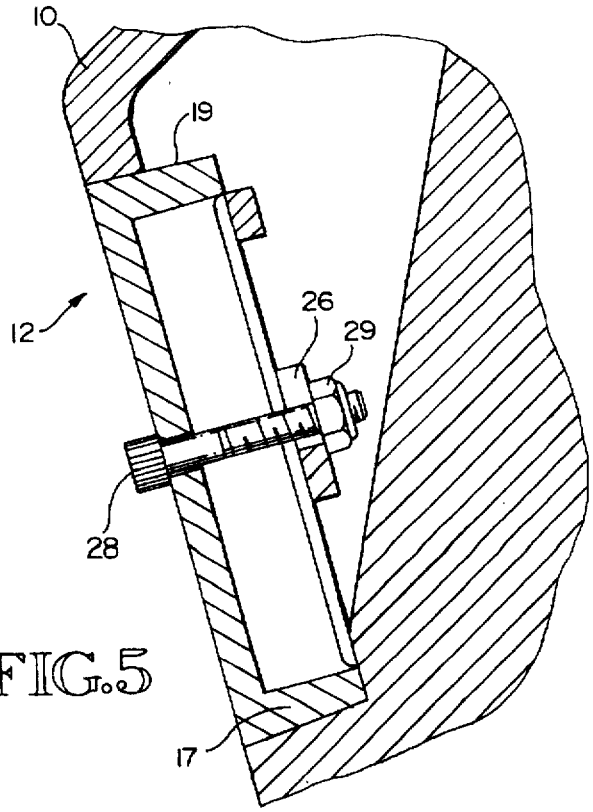
FIG. 5 is a side sectional view along lines 5—5 of FIG. 3 showing the inventive trim tab as mounted within a hollow rudder.
Figure 6:
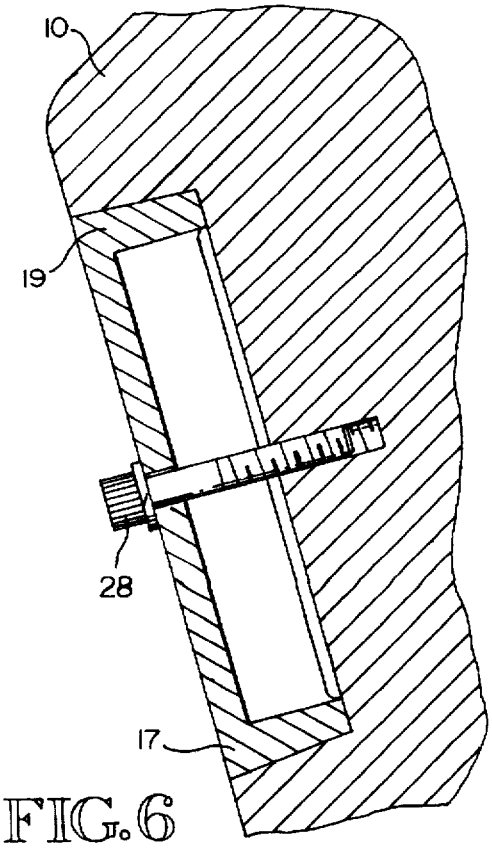
FIG. 6 is a view similar to FIG. 5, showing the inventive device mounted to a solid rudder.

As seen in FIGS. 5 and 6 the adjustable trim tab 12 is secured to the rudder by fastener 28 which in the case of the hollow rudder as seen in FIG. 5 is secured by passing through lower opening 26 of the rudder shell and being capped by a lock nut 29.

As seen in FIG. 6 the fastener 28 passes through the hollow interior portion of the trim tab and is secured directly into a threaded portion within the rudder 10. It is to be remembered that the adjustability of the trim tab is because of the fact that the opening 32 through the trim tab is elongated in a horizontal direction allowing movement when the fastener is loosened.

Thus, as can be seen, the current invention contemplates not only a light weight hollow rudder, but more critically, an adjustable rear portion of the rudder which may be moved out of plane with the sides of the rudder to compensate for torque or other forces causing the hull of the boat to turn.

I claim:

1. A rudder, including means to compensate for the torque generated by a single screw, comprising:

a main body member having a leading edge and a following edge, said main body member mounted for rotation about a line adjacent and substantially parallel to the leading edge, said following edge including a relieved portion extending along a small portion of its length;

fastening means forming a part of the rudder within the relived portion; and a trim element mating with the relieved portion, adapted to be placed at a predetermined angle to the side surface of the rudder to compensate for the torque generated by the propeller and then secured in place.

2. A rudder as in claim 1, wherein the back portion of the relieved portion is concave and the trim element includes a congruent surface.

* * * * *